US006530782B2

(12) United States Patent
Fouse et al.

(10) Patent No.: US 6,530,782 B2
(45) Date of Patent: Mar. 11, 2003

(54) LAUNCHER TRAINING SYSTEM

(75) Inventors: Timothy M. Fouse, Colonial Beach, VA (US); Michael M. Canaday, King George, VA (US); Vincent J. Vendetti, Fredericksburg, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 215 days.

(21) Appl. No.: 09/795,396

(22) Filed: Mar. 1, 2001

(65) Prior Publication Data

US 2002/0123025 A1 Sep. 5, 2002

(51) Int. Cl.[7] ..... F41G 1/00

(52) U.S. Cl. ..... 434/19; 434/11; 434/12; 434/20; 463/5

(58) Field of Search ..... 434/11–27, 307 R, 434/308, 365, 118; 463/5, 51–53; 273/358, 348.1, 359, 371; 348/121, 141, 836; 89/1.11, 41.06

(56) References Cited

U.S. PATENT DOCUMENTS

| | | | | | |
|---|---|---|---|---|---|
| 3,798,796 | A | * | 3/1974 | Stauff et al. | 434/20 |
| 3,997,762 | A | | 12/1976 | Ritchie et al. | |
| 4,232,456 | A | * | 11/1980 | Harmon et al. | 434/12 |
| 4,418,361 | A | | 11/1983 | Bagnall-Wild et al. | |
| 4,439,156 | A | * | 3/1984 | Marshall et al. | 434/12 |
| 4,457,716 | A | * | 7/1984 | Eserhaut et al. | 434/43 |
| 4,534,735 | A | * | 8/1985 | Allard et al. | 434/20 |
| 4,619,615 | A | * | 10/1986 | Kratzenberg | 434/22 |
| 4,644,845 | A | | 2/1987 | Garehime, Jr. | |
| 4,689,016 | A | * | 8/1987 | Eichweber | 434/22 |
| 4,824,374 | A | * | 4/1989 | Hendry et al. | 434/22 |
| 4,878,752 | A | | 11/1989 | Bramley | |
| 4,917,609 | A | * | 4/1990 | Eichweber | 434/20 |
| 4,922,801 | A | | 5/1990 | Jaquard et al. | |
| 4,936,190 | A | | 6/1990 | Pilcher, II | |
| 4,955,812 | A | | 9/1990 | Hill | |
| 4,993,819 | A | * | 2/1991 | Moorhouse | 359/419 |
| 5,215,462 | A | * | 6/1993 | Lewis et al. | 434/19 |
| 5,256,066 | A | * | 10/1993 | LaRussa | 434/21 |
| 5,340,115 | A | * | 8/1994 | Shirai et al. | 463/5 |
| 5,586,887 | A | | 12/1996 | McNelis et al. | |
| 5,690,492 | A | * | 11/1997 | Herald | 434/20 |
| 5,834,676 | A | | 11/1998 | Elliott | |
| 5,892,617 | A | | 4/1999 | Wallace | |
| 6,296,486 | B1 | * | 10/2001 | Cardaillac et al. | 434/12 |

* cited by examiner

*Primary Examiner*—Joe H. Cheng
(74) *Attorney, Agent, or Firm*—James B. Bechtel, Esq.; Peter J. Van Bergen, Esq.

(57) ABSTRACT

A launcher training system includes a housing shaped to resemble a projectile launcher. A hollowed-out portion of the housing defines a boresight axis. An optical sight is coupled to the housing such that the boresight axis and the optical sight's line-of-sight are fixed in relation to one another. The optical sight further defines a sight field-of-view (FOV) with a first reticle appearing therein. An imaging means in the hollowed-out portion of the housing generates an image in an image FOV thereof. Video signal transmitter are provided to transmit signals indicative of the image over the air waves. A remotely-located receiver station is provided to reproduce the image with a second reticle being overlaid thereon. The imaging means are adjustably positioned such that the image FOV is sighted along the boresight axis and such that the second reticle overlaid on the reproduced image appears at the same position as the first reticle in the sight FOV.

22 Claims, 2 Drawing Sheets

LAUNCHER TRAINING SYSTEM

ORIGIN OF THE INVENTION

The invention described herein was made in the performance of official duties by employees of the Department of the Navy and may be manufactured, used, licensed by or for the Government for any governmental purpose without payment of any royalties thereon.

FIELD OF THE INVENTION

The invention relates generally to weapons training, and more particularly to a launcher training system for use in training a user how to aim a projectile launcher while being monitored by an instructor.

BACKGROUND OF THE INVENTION

The military infantry must be skilled in the use of a variety of sophisticated weapons such as portable rocket launchers that are balanced on one's shoulder during use. While hands-on experience is the best way to train personnel how to properly use/aim such weapons, the limited availability and/or expense of "live" weapons often precludes their use in training exercises. Accordingly, simulated systems are often used for training. However, conventional simulated systems generally involve drastic modifications to a weapon that interfere with the use of the simulated weapon in the field. Further, there are currently no convenient ways for an instructor to monitor the training activities with either a simulated or live weapon.

SUMMARY OF THE INVENTION

Accordingly, it is an object of the present invention to provide a training system that can be used to train personnel how to aim a portable projectile (e.g., missile) launcher.

Another object of the present invention is to provide a portable projectile launcher training system that mimics the weight and balance of a rocket launcher loaded with a live round.

Still another object of the present invention is to provide a portable projectile launcher training system that allows an instructor to monitor aiming activity in real-time.

A still further object of the present invention is to provide a portable projectile launcher training system that can be used to provide feedback to personnel being trained therewith.

Yet another object of the present invention is to provide a projectile launcher training system that can be used in an outdoor field environment or in an indoor environment.

Other objects and advantages of the present invention will become more obvious hereinafter in the specification and drawings.

In accordance with the present invention, a launcher training system for use in training a user how to aim a projectile launcher. A housing, shaped to resemble a projectile launcher, has a hollowed-out portion defining a boresight axis. An optical sight having a line-of-sight is coupled to the housing where the boresight axis and line-of-sight are fixed in relation to one another. The optical sight further defines a sight field-of-view (FOV) with a first reticle appearing in the sight FOV. Fitted in the hollowed-out portion of the housing is an imaging means for generating an image in an image FOV thereof. Transmission means are provided to transmit signals indicative of the image over the air waves. A remotely-located receiver station is provided to reproduce the image and to for overlay a second reticle on the image so-reproduced. Mounted in the hollowed-out portion and coupled to the imaging means is a positioner for positioning the imaging means such that the image FOV is sighted along the boresight axis and such that the second reticle overlaid on the reproduced image appears at the same position as the first reticle in the sight FOV.

DETAILED DESCRIPTION OF THE INVENTION

Figure 1:
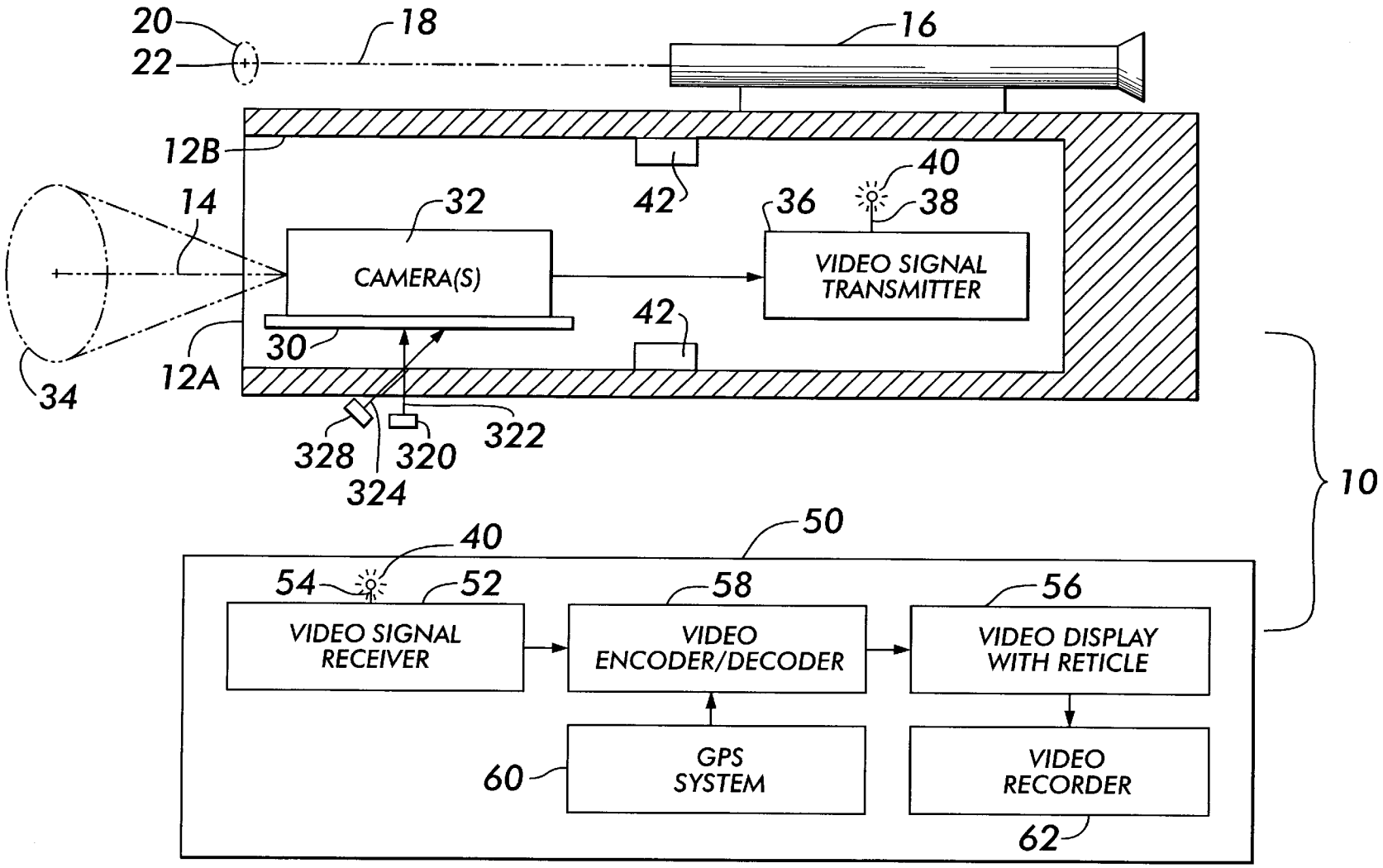
FIG. 1 is a functional block diagram of an embodiment of a portable projectile launcher training system according to the present invention.

Referring now to the drawings, and more particularly to FIG. 1, a launcher training system according to the present invention is shown and referenced generally by numeral 10. While the present invention will be described for training personnel in the use of a portable, shoulder-launched missile system, it is to be understood that the present invention can be used to train personnel in the use of any projectile launcher that is aimed by means of an optical sight mechanism.

Launch training system 10 has a housing 12 that is sized and shaped to resemble the particular projectile launcher that system 10 is simulating. Housing 12 is open at an end 12A thereof and has a hollowed-out portion 12B that defines a mounting volume for some of the elements of system 10. Hollowed-out portion 12B is formed about and includes the central longitudinal axis 14 of housing 12 which, in terms of a projectile launcher, is equivalent to the boresight axis of the launcher being simulated.

Mounted on housing 12 is an optical sight 16 that should be the same optical sight used with the particular projectile launcher of interest. Further, optical sight 16 is mounted on housing 12 in the same position as would be found on the particular projectile launcher of interest. Optical sight 16 has a line-of-sight 18 and will present a viewer with a field-of-view 20. An angular relationship between boresight axis 14 and line-of-sight 18 is fixed and determined by the design of the particular projectile launcher being simulated by system 10. Accordingly, this relationship is not a limitation of the present invention. Optical sight 16 includes a reticle or "cross-hairs" such that field-of-view 20 will incorporate same as referenced at 22.

Mounted in hollowed-out portion 12A is a movable and lockable platform 30 supporting one or more video camera(s) 32 thereon. That is, camera(s) 32 can be a single camera capable of imaging in daylight and/or darkness, or multiple cameras with each camera designed for a specific purpose, e.g., one daylight camera and one night camera that can image in darkness. Platform 30 is equipped to move camera(s) 32 in two orthogonal directions, e.g., up/down and side-to-side as indicated by arrows 322 and 324, respectively. Such movement is effected by means of manually-operated adjusters 320 and 328, the choice of which is not a limitation of the present invention. Platform 30 is adjusted to position a field-of-view 34 of one of camera(s) 32 as will be explained further below.

Camera(s) 32 are coupled to a video signal transmitter 36 that typically includes an antenna 38. The video signals generated by one of camera(s) 32 are indicative of the image in field-of-view 34, and are transmitted over the air waves via antenna 38 as indicated at 40. Such operation is well understood in the field of wireless transmission.

If necessary, system 10 can also include one or more weights 42 mounted in, on or integrated with housing 12. Weights 42 are used to make housing 12 and its housed components have the same weight and balance as that of the projectile launcher being simulated.

Video signals 40 are detected and processed by remotely-located receiver module 50. At a minimum, receiver module 50 includes a video signal receiver 52 and a video display 56. Receiver 52 typically has an antenna 54 for receiving video signals 40. Receiver 52 supplies the received video signals to a video display 56 that incorporates a reticle or cross-hairs in the image area of display 56. The reticle can be permanently fixed (e.g., painted, marked, etched, etc.) on the image area of display 56. Alternatively, the reticle could be generated as a superimposed image on display 56 by, for example, a video encoder/decoder 58 coupled between receiver 52 and display 56. Other superimposed information that can be provided by video encoder/decoder 58 includes event information and "arm and fire" information. Further, GPS position/time information can be provided by GPS system 60 through video encoder/decoder 58. The images on display 56 can be recorded by means of a video recorder 62 for later viewing.

Prior to being used in training exercises, system 10 must be set-up or calibrated in the following manner. With housing 12 held in a fixed position (e.g., on a tripod), a user looks through optical sight 16 whereby object(s) in field-of-view 20 are seen. Housing 12 is positioned such that reticle 22 is superimposed on some discernible object of reference in field-of-view 20. Next, one of camera(s) 32 is selected/activated and receiver module 50 is turned on so that the image in field-of-view 34 appears on display 56. Platform 30 is then positioned so that the reticle on display 56 is referenced to the same object as reticle 22. Accordingly, during set-up, receiver module 50 will be adjacent housing 12.

In use of system 10, a trainee sights a target (not shown) using optical sight 16. With one of camera(s) 32 positioned as just described, the image on display 56 will be identical to that being viewed through optical sight 16. Thus, an instructor can monitor how housing 12 is being "aimed" while the trainee is actually doing so. Feedback to the trainee can be provided in the form of verbal comments (using a radio if necessary) and/or in the form of video recording of the training session made by video recorder 60.

The advantages of the present invention are numerous. Personnel can be trained in the use of a projectile launcher without the need of the actual launcher and its projectile. The portion of the system used by a trainee resemble the projectile launcher being simulated in terms of size, shape, weight and balance. The portion of the system used by an instructor can be remotely-located with respect to the trainee's portion of the system. This structure allows the trainee to truly operate "in the field" without clumsy modifications to his portion of the system. This structure will also provide the trainee with the sense of independent operation since the instructor need not be with the trainee or standing over him watching him work. Rather, feedback need only be provided on an "as needed" basis. Thus, the present invention will quickly foster independent thinking on the part of the trainee and allow the trainee to quickly learn and be confident in his training.

Figure 2:
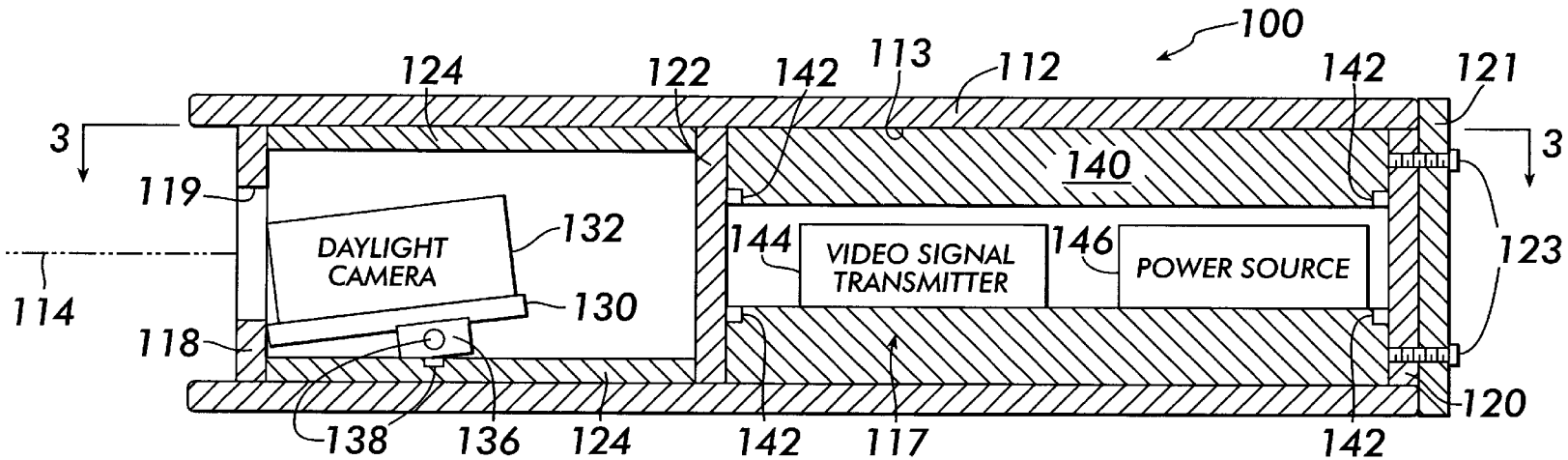
FIG. 2 is a cut-away side view of the trainee portion of one embodiment of the present invention depicting the housing module fitted in a launch tube in accordance with the present invention.
Figure 3:
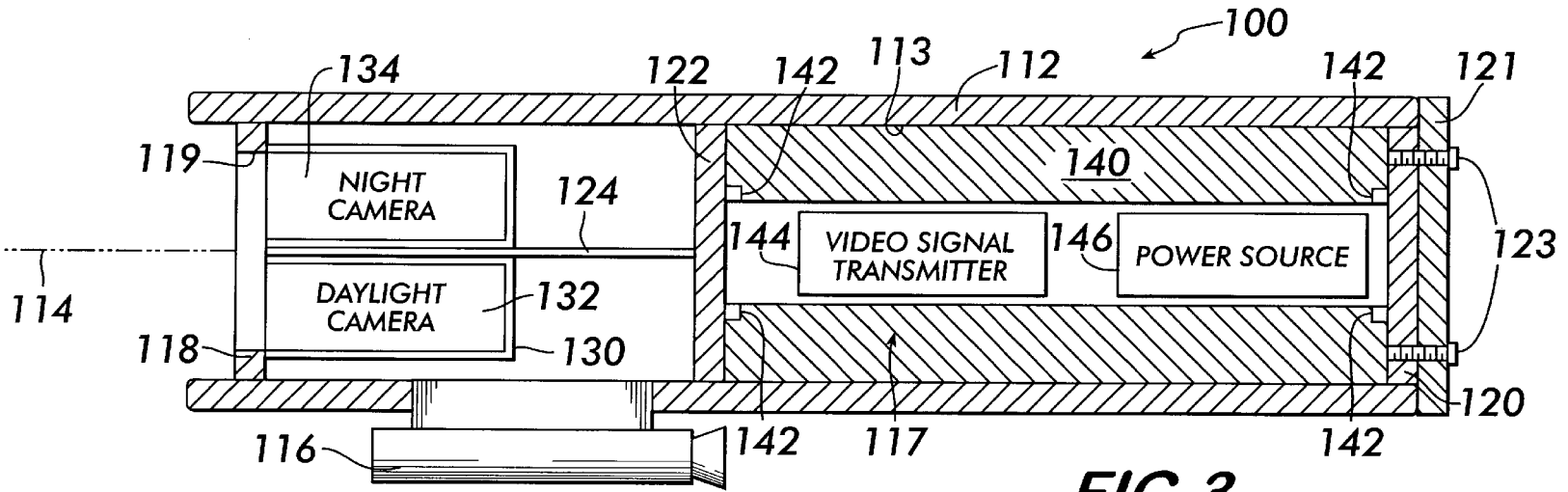
FIG. 3 is a view of the housing module taken along line 3—3 of FIG. 2.

Although the present invention can be implemented mechanically in a variety of ways without departing from the present invention's scope, the mechanical aspects of one embodiment of a trainee portion 100 will be explained herein by way of example with the aid of FIGS. 2 and 3. Trainee.portion 100 includes a launch tube 112 (e.g., the U.S. Marine's Predator Anti-Armor Missile launch tube) having a bore 113 formed along the length thereof where numeral 114 references the boresight axis of bore 113. An optical sight 116 is coupled to the forward portion of launch tube 112, and has a reticle, a line-of-sight and an image field-of-view as described above.

Mounted in launch tube 112 is a housing module 117 having end plates 118 and 120, and having a central plate 122 positioned between plates 118 and 120. Plates 118/120/122 are sized/shaped to slidingly engage bore 113. O-rings (not shown) can be provided about the plates' perimeters to form a good seal with bore 113. Housing module 117 is fixed in launch tube 112 by a capture plate 121 that abuts the breech end of launch tube 112 and bolts to plate 120 using bolts 123. Plates 118 and 122 are fixedly coupled to one another by frame members 124.

Mounted on frame members 124 is an adjustable platform 130 that supports both a daylight camera 132 and a night camera 134 that can focus through a central aperture 119 in plate 118. An adjustment mechanism 136, including manually-operated adjustment screws 138, couples platform 130 to lower frame member(s) 124. Movement of adjustment screws 138 effects lateral and vertical movement of platform 130 and cameras 132 and 134 to allow the set-up operation (described above) to be performed.

Plates 122 and 120 are fixedly coupled one another by a framework 140 that supports and protects the electronic components coupled to cameras 132 and 134. Framework 140 can be attached to plates 122 and 120 at flanges 142. Such electronic components include a video signal transmitter 144 and a power source 146. Note that the various wiring of the components supported by housing module 117 is omitted for clarity of illustration.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. A launcher training system for use in training a user how to aim a projectile launcher, comprising:

a housing shaped to resemble a projectile launcher, said housing having a hollowed-out portion defining a boresight axis;

an optical sight having a line-of-sight, said optical sight coupled to said housing wherein said boresight axis and said line-of-sight are fixed in relation to one another, said optical sight further defining a sight field-of-view (FOV) and a first reticle in said sight FOV;

first means fitted in said hollowed-out portion for generating an image, said first means having an image FOV;

second means coupled to said first means for transmitting signals indicative of said image over the air waves;

third means remotely located with respect to said housing for reproducing said image using said signals and for overlaying a second reticle on said image so-reproduced; and fourth means mounted in said hollowed-out portion and coupled to said first means for positioning said first means such that said image FOV is sighted along said boresight axis and such that said second reticle overlaid on said image so-reproduced appears at the same position as said first reticle in said sight FOV.

2. A launcher training system as in claim 1 further comprising fifth means mounted in said housing for weighting and balancing said housing to mimic the weight and balance of the projectile launcher.

3. A launcher training system as in claim 1 wherein said first means comprises at least one camera capable of generating said image in daylight and darkness.

4. A launcher training system as in claim 1 wherein said second means is a video signal transmitter mounted in said housing.

5. A launcher training system as in claim 1 wherein said third means comprises:

a video signal receiver for receiving said signals; and a video display coupled to said video signal receiver for reproducing said image.

6. A launcher training system as in claim 5 further comprising a video recorder coupled to said video display for recording said image so-reproduced.

7. A launcher training system as in claim 5 wherein said second reticle is permanently marked on said video display.

8. A launcher training system as in claim 5 wherein said second reticle is a video image displayed on said video display.

9. A launcher training system for use in training a user how to aim a projectile launcher, comprising:

a housing shaped to resemble a projectile launcher, said housing having a hollowed-out portion defining a boresight axis;

an optical sight having a line-of-sight, said optical sight coupled to said housing wherein said boresight axis and said line-of-sight are fixed in relation to one another, said optical sight further defining a sight field-of-view (FOV) and a first reticle in said sight FOV;

a first video camera mounted in said hollowed-out portion, said first video camera having a first FOV and generating a first video signal indicative of a first image;

a second video camera-mounted in said hollowed-out portion, said second video camera having a second FOV and generating a second video signal indicative of a second image;

a video signal transmitter mounted in said housing and coupled to said first video camera and said second video camera for transmitting a selected one of said first video signal and said second video signal over the air waves;

a video signal receiver remotely located with respect to said housing for receiving said first video signal and said second video signal;

a video display coupled to said video signal receiver for displaying, at any given time, one of said first image and said second image and for overlaying a second reticle on said one of said first image and said second image; and positioning means mounted in said hollowed-out portion and coupled to said first video camera and said second video camera for positioning said selected one of said first video camera and said second video camera such that a corresponding one of said first FOV and said second FOV is sighted along said boresight axis and such that said second reticle overlaid on said one of said first image and said second image appears at the same position as said first reticle in said sight FOV.

10. A launcher training system as in claim 9 wherein said first video camera operates in daylight and said second video camera operates in darkness.

11. A launcher training system as in claim 10 further comprising means mounted in said housing for weighting and balancing said housing to mimic the weight and balance of the projectile launcher.

12. A launcher training system as in claim 9 further comprising a video recorder coupled to said video display for recording one of said first image and said second image.

13. A launcher training system as in claim 9 wherein said second reticle is permanently marked on said video display.

14. A launcher training system as in claim 9 wherein said second reticle is a video image displayed on said video display.

15. A launcher training system for use in training a user how to aim a projectile launcher, comprising:

a first housing shaped to resemble a projectile launcher, said first housing having a bore defining a boresight axis;

an optical sight having a line-of-sight, said optical sight coupled to said first housing wherein said boresight axis and said line-of-sight are fixed in relation to one another, said optical sight further defining a sight field-of-view (FOV) and a first reticle in said sight FOV;

a second housing fitted in said bore and coupled to said first housing;

first means coupled to said second housing for generating an image, said first means having an image FOV;

second means coupled to said first means for transmitting signals indicative of said image over the air waves;

third means remotely located with respect to said first housing for reproducing said image using said signals and for overlaying a second reticle on said image so-reproduced; and fourth means coupling said first means to said second housing for positioning said first means such that said image FOV is sighted along said boresight axis and such that said second reticle overlaid on said image so-reproduced appears at the same position as said first reticle in said sight FOV.

16. A launcher training system as in claim 15 wherein said first means comprises at least one camera capable of generating said image in daylight and darkness.

17. A launcher training system as in claim 15 wherein said second means is a video signal transmitter.

18. A launcher training system as in claim 15 wherein said third means comprises:

a video signal receiver for receiving said signals; and a video display coupled to said video signal receiver for reproducing said image.

19. A launcher training system as in claim 18 further comprising a video recorder coupled to said video display for recording said image so-reproduced.

20. A launcher training system as in claim 18 wherein said second reticle is permanently marked on said video display.

21. A launcher training system as in claim 18 wherein said second reticle is a video image displayed on said video display.

22. A launcher training system as in claim 15 wherein said second housing comprises:

first and second end plates slidingly fitted within said bore; and a framework coupling said first and second end plates to one another.

* * * * *